US008739668B2

(12) United States Patent
Negrello et al.

(10) Patent No.: US 8,739,668 B2
(45) Date of Patent: Jun. 3, 2014

(54) BLANKING DIE WITH DEVICE FOR REPLACING AT LEAST ONE PUNCH

(75) Inventors: Massimo Negrello, Lainate (IT); Dario Muti, Milan (IT); Mario Checchin, Tradate (IT)

(73) Assignee: Corrado S.p.A., Lainate (MI) (IT)

( * ) Notice: Subject to any disclaimer, the term of this patent is extended or adjusted under 35 U.S.C. 154(b) by 183 days.

(21) Appl. No.: 13/474,511

(22) Filed: May 17, 2012

(65) Prior Publication Data

US 2012/0291605 A1 Nov. 22, 2012

(30) Foreign Application Priority Data

May 20, 2011 (IT) ..... MI2011A0904

(51) Int. Cl.

| | |
|---|---|
| ***B26D 5/04*** | (2006.01) |
| ***B21D 28/34*** | (2006.01) |
| ***B23D 75/00*** | (2006.01) |
| ***B26D 1/00*** | (2006.01) |

(52) U.S. Cl.

USPC ..... 83/563; 234/94

(58) Field of Classification Search

CPC ..... B21D 1/00; B21D 28/34; A61F 31/00; A61F 2/00; B23D 75/00; B26D 1/00; B26D 2001/00; B26D 2210/00; B65H 1/00; B26F 1/00

USPC ..... 83/563, 100, 549, 684, 687, 682, 686, 83/671, 698.91; 234/118, 94, 104, 109, 234/114; 29/759, 760, 761, 243.5, 823

See application file for complete search history.

(56) References Cited

U.S. PATENT DOCUMENTS

| | | | | |
|---|---|---|---|---|
| 3,685,380 | A | 8/1972 | Daniels | |
| 4,685,613 | A | 8/1987 | Schambre | |
| 4,914,996 | A * | 4/1990 | Lavorel | 83/151 |
| 5,669,866 | A * | 9/1997 | Julian et al. | 483/1 |
| 6,006,636 | A * | 12/1999 | Baldwin et al. | 83/13 |
| 7,086,582 | B2 * | 8/2006 | Yang et al. | 234/109 |
| 2006/0070233 | A1 | 4/2006 | Neunschwander et al. | |
| 2010/0229701 | A1 | 9/2010 | Thielges et al. | |

FOREIGN PATENT DOCUMENTS

| | | |
|---|---|---|
| DE | 1502721 | 1/1970 |
| EP | 1859876 | 5/2006 |

OTHER PUBLICATIONS

Search Report of Italian Application MI2011A000904 filed May 20, 2011 in the name of Corrada S.P.A., Date of Completion: Mar. 28, 2012.

Written Opinion of Italian Application MI2011A000904 filed May 20, 2011 in the name of Corrada S.P.A., Date of Completion: Mar. 28, 2012.

Italian Search Report completed on Apr. 2, 2012 for Italian Application No. MI2011A001378 filed on Jul. 25, 2012 in the name of Corrada S.P.A.

* cited by examiner

*Primary Examiner* — Ghassem Alie
(74) *Attorney, Agent, or Firm* — Steinfl & Bruno, LLP

(57) ABSTRACT

A sheet metal blanking die has a lower and an upper part and guide columns for maintaining the parts aligned. The upper part presents a plurality of punches which project downwards from it, when the die is closed by a press. Recesses are present on the flat lower portion to receive the respective punches at the moment of blanking. For one punch a rapid replacement device can be provided, including a chamber within which a loader can move presenting two cavities of vertical axis to receive relative punches. By moving the loader a punch can be selected for transfer from a rest position to an operative blanking position.

6 Claims, 3 Drawing Sheets

BLANKING DIE WITH DEVICE FOR REPLACING AT LEAST ONE PUNCH

CROSS REFERENCE TO RELATED APPLICATIONS

The present application claims priority to Italian patent application MI2011A000904 filed on May 20, 2011, which is incorporated herein by reference in its entirety.

FIELD

The present disclosure relates to a blanking die with a device for replacing at least one punch.

BACKGROUND

Common blanking dies are known, for example for producing magnetic laminations and/or magnetic lamination packs for electric motors and generators. These dies usually present a lower part and an upper part. These two parts are mutually aligned by guide columns. The die upper and lower parts present corresponding substantially flat portions known respectively as the flat lower portion or die plate and the flat upper portion or punch guide plate or punch stripping plate. With the die open, sheet metal in the form of a strip is fed to the die, to rest on the die plate. The die upper part presents a plurality of punches which project from the punch guide plate during blanking, when the die is closed by the action of the press. The punches then blank the laminations. For blanking purposes, recesses are provided in the die plate in positions corresponding with the punches, to receive said punches in order to implement the blanking operation. On closing the die, the punches press on the sheet metal in positions corresponding with the portion under which the relative recesses lie. Blanking is then achieved by cutting forces which the punches generate on the sheet metal at the recesses.

A part of the die upper portion located above the punches is known as the closure plate. The closure plate can be opened/disassembled (completely or partly) to replace the punches.

This solution presents however various drawbacks linked to punch replacement. In this respect, the punches need to be replaced following breakage/wear or because of changing conditions which produce results outside the required tolerance ranges. Punches are usually replaced after opening and totally or partially dismantling the closure plate. However, as the punch replacement operation involves disassembly of the die, there is consequent stoppage of the blanking operations and interruption of production. This replacement operation can last many hours, and only afterwards can die productivity be resumed.

SUMMARY

According to an aspect of the present disclosure, a sheet metal blanking die is disclosed, comprising: a lower part, an upper part and guide columns for maintaining the lower part and upper part aligned during movement of the upper part relative to the lower part in order to close or open the die or to blank the sheet metal to obtain relative blanked laminations, wherein the upper part and the lower part comprise respective upper and lower flat parallel mutually opposing horizontal portions, the lower flat portion being adapted to receive the sheet metal, the upper flat portion comprising a plurality of punches which project downwards from the upper flat portion upon blanking when, by action of a press, the die is closed onto said lower flat portion, the lower flat portion comprising blanking recesses to receive respective punches, the die further comprising, for at least one of the punches, a device for replacing the relative punch, said device comprising: a chamber provided in the upper part of the die, within which chamber a loader can move, the loader comprising at least two cavities having a vertical axis and having apertures at their two upper and lower ends, to receive relative punches, wherein one of the cavities is adapted, through movement of the loader, to correspond with a through seat provided in a punch holder and positioned below the loader, the through seat and relative cavity being coaxial with a corresponding blanking recess of the lower part of the die, the through seat enabling a punch to be transferred from a rest position, in which the punch is completely contained within the relative cavity, to an operating blanking position, the loader comprising a solid part which is adapted to be brought into a position corresponding with said through seat by moving the loader; a first pneumatic means enabling a pressurized fluid to be fed to that cavity located in a position corresponding with the through seat, to cause the punch to move from the rest position to the operative blanking position; moving means for moving the loader to bring one of the cavities of the loader or the solid part of the loader into a position corresponding with said through seat; a second pneumatic means to be activated when the first pneumatic means is inactive and when the loader lies in a position in which the relative loader cavity corresponds with the punch when in its operative position, said second pneumatic means enabling the punch to be returned from the operative position to the rest position; and means for closing the through seat.

Further aspects of the present disclosure are shown in the specification, drawings and claims of the present application.

According to several embodiments of the present disclosure, easy and quick punch replacement is enabled without having to disassemble the die, hence considerably reducing the down time and providing greater production continuity.

BRIEF DESCRIPTION OF THE DRAWINGS

The teachings of the present disclosure will be more apparent from the accompanying drawings, which are provided by way of non-limiting example and in which.

DETAILED DESCRIPTION

Figures 1A, 1B:
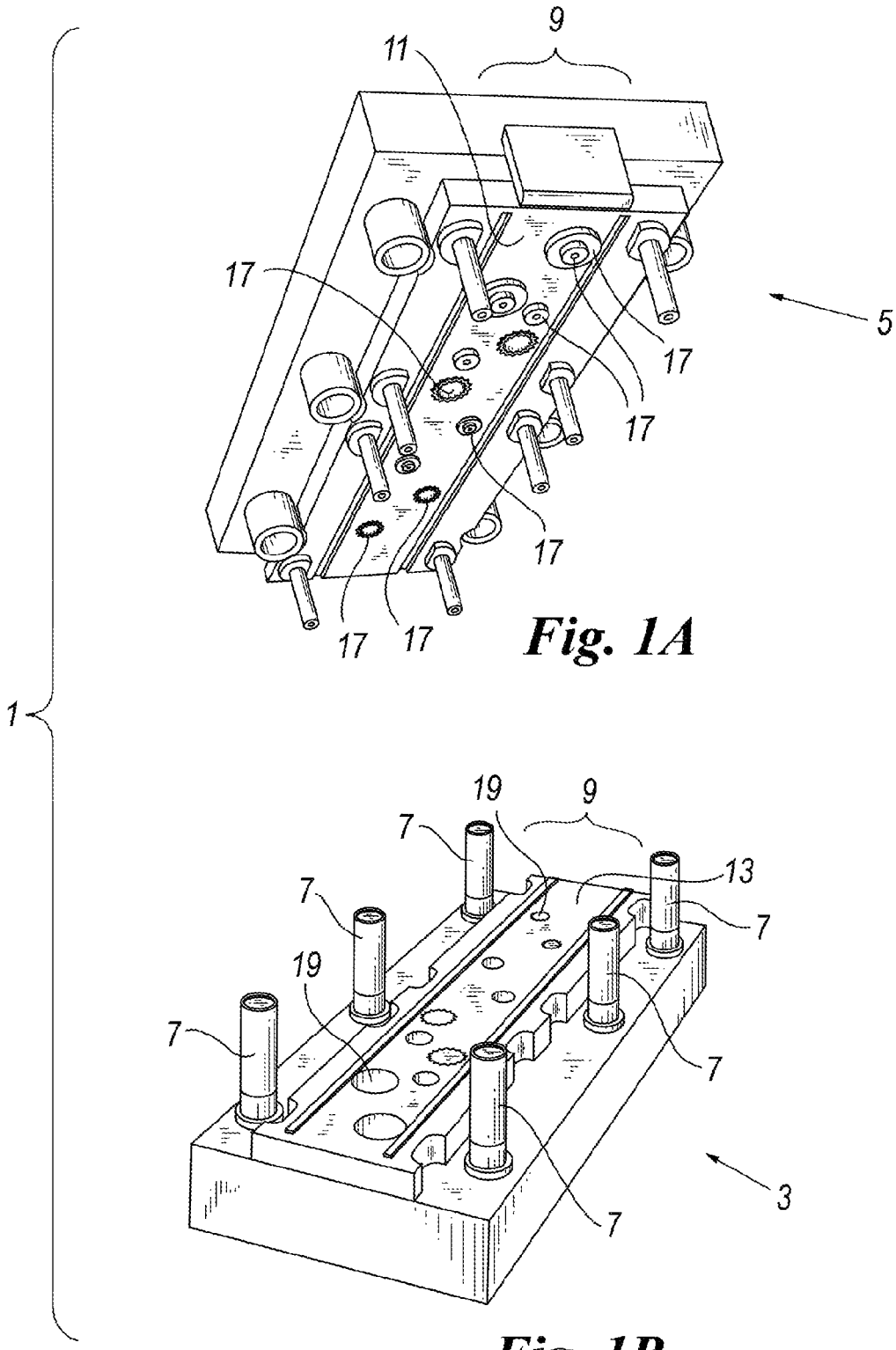
FIG. 1A is a perspective view of the upper part of a blanking die for laminations.
FIG. 1B is a perspective view of the lower part of the same die.

With reference to FIGS. 1A and 1B, a blanking die is indicated overall with reference numeral 1. The die 1 usually presents a lower part 3 and an upper part 5. These two parts are mutually aligned by the die 1 guide columns 7. The columns 7 enable the die upper part 5 to be maintained aligned with the lower part 3 during closure and opening operations and during blanking. In a central portion 9 of the die 1 the die upper part 5 and lower part 3 present substantially flat portions known respectively as the flat upper portion 11 or punch guide plate or punch stripping plate, and the flat lower portion 13 or die plate. With the die 1 open, sheet metal normally in the form of a strip (not shown in the figure) is fed into the die 1 so as to rest on the die plate 13.

The upper part 5 of the die 1 presents a plurality of punches 17 which at the moment of blanking project from said punch guide plate 11 to penetrate into the relative recesses 19 present in the die plate 13. The device comprises at least one active punch 17 blanking the sheet metal, with a corresponding plurality of punches 39 (FIG. 3) in a rest or non-active position.

On closing the die 1, the punches 17 press onto the sheet metal at that sheet metal portion below which said recesses 19 are positioned. Blanking is then achieved by cutting forces which the punch 17 generates on the sheet metal at the recesses 19.

A portion 23 of the die 1 upper part 5 situated above the punches 39 constitutes the said closure plate. The closure plate 23 can be completely or partly opened/disassembled.

In a portion overlying the punch 17, the die 1 upper part 5 presents a chamber 25 to which access can be gained after opening/disassembling the closure plate 23. The chamber 25 is closed upperly by the closure plate 23 and houses a loader. In this specific case said loader is a loading tray 31. This latter can slide within the chamber 25 in the direction indicated by the arrow A or alternatively in the opposite direction. The tray 31 is constrained vertically by the closure plate 23. The tray 31 presents a plurality of vertical cavities 33 having their axis parallel to that of the punch 17.

The cavities 33 are open at their upper and lower ends, to form apertures 35 and 37 respectively.

Figure 2:
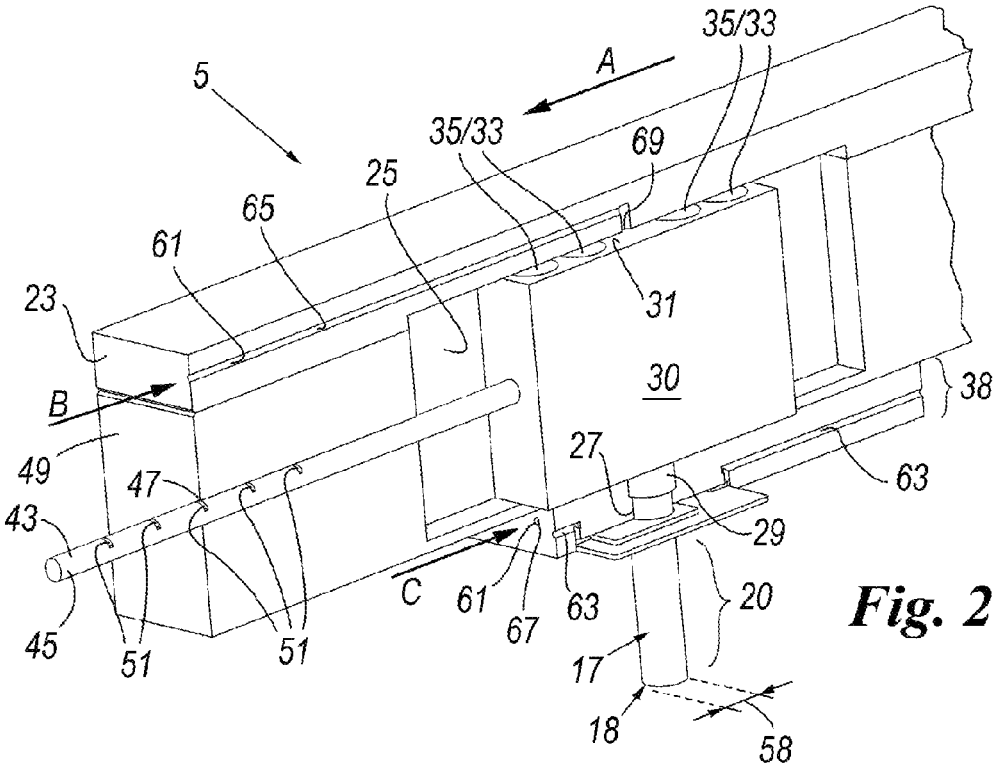
FIGS. 2 and 3 are two different sectional views of a portion of the die upper part.
Figure 3:
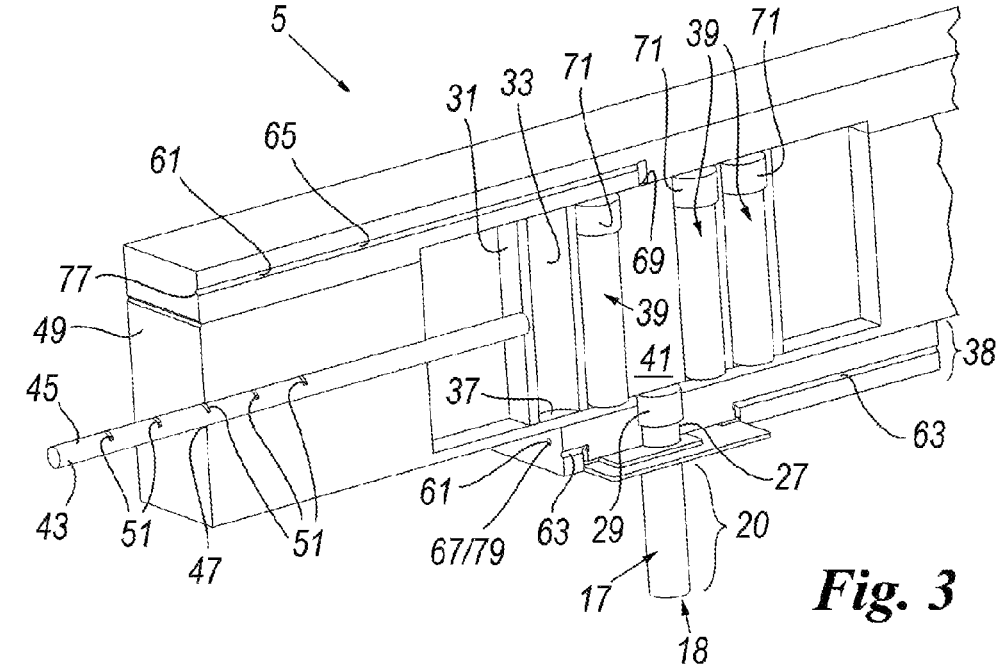

In a lower portion, the chamber 25 presents an aperture to enable a punch to pass from the relative cavity 33 to the punch holder 38 such that the head 29 of the punch 17 becomes inserted into a seat 27. The punch also presents a lower base 18 and a punch body 20 (FIGS. 2 and 3). When abuttingly housed in the seat 27, the punch 17 lies in a position known as the operative position.

The upper aperture 35 of the cavity 33 enables a fluid present in a first pneumatic means 65 (described hereinafter) to pass in order to transfer a punch 39 housed in the relative cavity 33 of the tray 31 from a rest position to an operative position. The lower aperture 37 enables the punch 39 to be transferred from an operative position (punch projecting downwards with its head 29 housed in the corresponding seat 27) to a rest position (punch 39 housed in the relative cavity 33 of the tray 31) and vice versa.

As stated, the tray 31 is able to house a determined number of punches 39. When housed in the relative cavity 33 of the tray 31, a punch 39 lies in the aforedefined rest position. By sliding the tray 31 in the direction of the arrow A or in the opposite direction, one of said cavities 33 can be positioned to correspond with the through seat 27, to enable the punch to pass from the cavity 33 to the through seat 27 and vice versa. The seat 27 presents a lower aperture 28.

In addition to said cavities 33, the tray 31 presents a solid portion 41 to maintain the punch 17 (when in the operative position) abuttingly housed securely in the through seat 27, by acting as a stop (FIG. 3).

The tray 31 is connected in a lateral portion thereof to a mover means. In the specific case, this latter is an elongated rod 45 which slides in an aperture/through hole 47 positioned on the outer surface 49 of the die 1.

When slid in the direction indicated by the arrow A (or in the opposite direction), the mover means enables the tray 31 to move within the cavity 25.

The rod 45 also presents on its surface a series of references 51 in the form of transverse notches. The references 51 enable identification of which of the chambers 33 lies above the through hole 27. In particular, these references enable a determined chamber 33 to be positioned above the through seat 27, such that these lie mutually coaxial.

Figure 4:
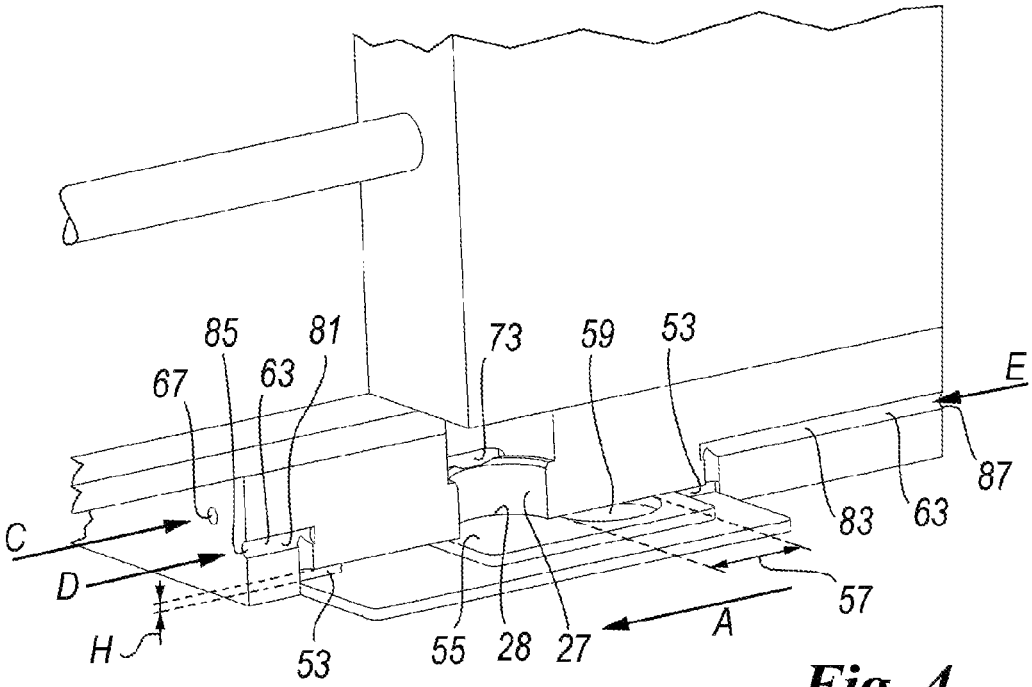
FIG. 4 is a detail of the upper part portion of FIG. 2 in a different condition.
Figure 5:
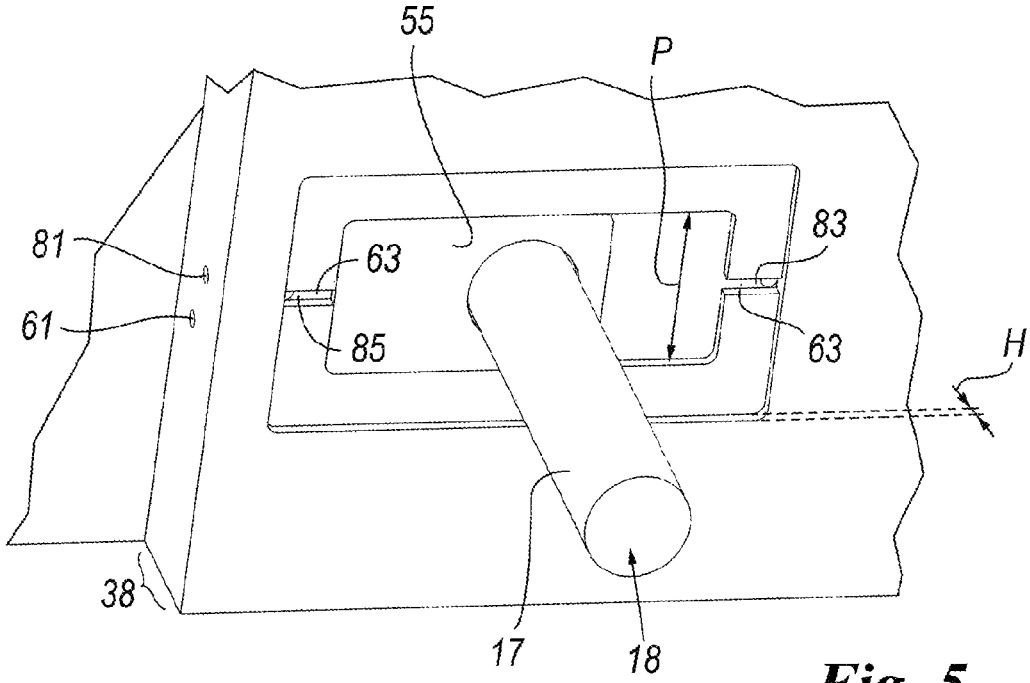
FIG. 5 is a detail of a portion of the die upper part.

Below the through seat 27 a further chamber 53 is present having preferably a height H which is small compared with the depth P (FIG. 5). The chamber 53 houses in its interior a diaphragm 55 for closing the through seat 27 (FIG. 4). This diaphragm can pass from an opening position (FIGS. 2 and 3) to a closing position (FIG. 4) or vice versa.

The diaphragm 55 presents in a portion 57 a through hole 59 of diameter 57 greater than the diameter 58 of the punch lower part 20 (FIG. 4) to enable it to pass.

In a similar manner to the tray 31, the diaphragm 55 can be moved in the direction indicated by the arrow A (or in the opposite direction) in order to substantially hermetically seal the through seat 27 (closing position of the diaphragm 55) or to position the hole 59 below it in line with the through seat 27 (opening position of the diaphragm 55).

To transfer the punches 39 from a rest position to an operative position (or vice versa), a pneumatic means is provided within which a process fluid is present, such as compressed air.

The pneumatic means comprises a first 61 and a second 63 pneumatic circuit having different functionalities.

The first pneumatic circuit 61 enables the punch 17 to be transferred from the operative position to the rest position and vice versa, and comprises a first pneumatic means 65 and a second pneumatic means 67.

The first pneumatic means 65 conveys compressed air to an aperture 69 positioned to correspond with a head 71 of the punch 39 to be transferred from the rest position to the operative position (punch 17 in FIG. 3).

The second pneumatic means 67 conveys compressed air to an aperture 73 positioned in the seat 27 (FIG. 4). In particular, the aperture 73 is positioned immediately below the head 29 of the punch 17, in order to transfer this latter from the operative position to the rest position (punch 39 in FIG. 3).

The first pneumatic means 65 and the second pneumatic means 67 present, in proximity to the respective ends 77 and 79 (FIG. 3), a device for feeding compressed air into said conduits, in the direction of the arrows C and B respectively (FIG. 2).

Said pneumatic circuit 63 (FIG. 4) comprises a third pneumatic means 81 and a fourth pneumatic means 83, and enables the diaphragm 55 contained in the chamber 53 to be moved in order to open and close the seat 27.

The third pneumatic means 81 conveys compressed air to a left end of the cavity 53, while the fourth pneumatic means 83 conveys compressed air to a right end of the cavity 53.

The third 81 and fourth 83 pneumatic means present in proximity to the respective apertures 85 and 87 a device for feeding compressed air into said means 81 and 83, in the direction of the arrows D and E respectively (FIG. 4).

According to an embodiment of the disclosure, the operation is substantially as follows:

when the punch 17 housed in the seat 27 is to be replaced, the tray 31 is slid in the direction of the arrow A or in the opposite direction to release the head 29 of the punch 17 from the solid portion 41 of the tray 31 and to position an empty cavity 33 above the head 29 of the punch 17;

compressed air is fed to the second pneumatic means 67 (in the direction of the arrow C) and to the third pneumatic means 81 (in the direction of the arrow D) in order to transfer the punch 17 from the operative position to the rest position and to close the seat 27 by moving the diaphragm 55 from an opening position to a closing position, as soon as the seat has been released by the punch 17;

when the diaphragm 55 is in its closing position, the air feed to the third pneumatic means 81 is halted;

the tray 31 is shifted by the slide means 43 such as to position one of the punches 39 contained in the tray 31 above and coaxially to the seat 27;

compressed air is fed to the fourth pneumatic means 83 (in the direction indicated by the arrow E) in order to move the diaphragm 55 from a closing position to an opening position, to reopen the seat 27;

when the diaphragm 55 is in the opening position, the air feed to the fourth pneumatic means 83 and to the second pneumatic means 67 is halted;

compressed air is fed to the first pneumatic means 65 (in the direction indicated by the arrow B) in order to facilitate the fall of the punch 39 by gravity from its rest position to its operative position;

when the head 71 of the punch 39 is housed in the seat 27 the air feed to the first pneumatic means 65 is halted;

the tray 31 is then shifted such as to position the solid part 41 of the tray 31 above the head 71 of the punch 39 (now housed in the seat 27) in order to maintain the punch 39 abutting in the operative position.

The times and methods of feeding the pneumatic means are indicative.

The punches 39 can either be replacement punches for the punch 17 (when the punch 17 is worn or broken) or punches having a slightly different diameter 58 of the lower part 20 when the use of sheet metal of different characteristics means that the requested tolerance ranges are no longer respected.

According to a further embodiment of the present disclosure, the loader can be a drum loader (not shown for simplicity but formable in a manner apparent to an expert of the art). Said drum, in a manner similar to the tray 31, presents a plurality of radially disposed chambers arranged to vertically house a plurality of punches.

The drum is evidently housed in a relative cavity of the upper part 5 of the die 1 and can rotate about its own axis of rotation to position one of its chambers coaxially above the seat 27. In a similar manner to the tray 31, the drum presents a solid portion to maintain the punch in the operative position, abuttingly housed securely in the through seat 27.

According to a further embodiment of the present disclosure, the loader can be moved for example by an electric motor, a pneumatic actuator or a suitable pneumatic circuit.

By way of example, the working fluid is air.

A number of embodiments of the disclosure have been described. The specific embodiments provided herein are examples of useful embodiments of the disclosure and it will be apparent to one skilled in the art that the disclosure can be carried out using a large number of variations of the devices, device components, methods steps set forth in the present description. As will be obvious to one of skill in the art, methods and devices useful for the present methods can include a large number of optional composition and processing elements and steps.

In particular, it will be understood that various modifications may be made without departing from the spirit and scope of the present disclosure. Accordingly, other embodiments are within the scope of the following claims.

The invention claimed is:

1. A sheet metal blanking die, comprising:

a lower part, an upper part and guide columns for maintaining the lower part and upper part aligned during movement of the upper part relative to the lower part in order to close or open the die or to blank the sheet metal to obtain relative blanked laminations, wherein the upper part and the lower part comprise respective upper and lower flat parallel mutually opposing horizontal portions, the lower flat portion being adapted to receive the sheet metal, the upper flat portion comprising a plurality of punches which project downwards from the upper flat portion upon blanking when, by action of a press, the die is closed onto said lower flat portion, the lower flat portion comprising blanking recesses to receive respective punches, the die further comprising, for at least one of the punches, a device for replacing the relative punch, said device comprising:

a chamber provided in the upper part of the die, within which chamber a loader can move, the loader comprising at least two cavities having a vertical axis and having apertures at their two upper and lower ends, to receive relative punches, wherein one of the cavities is adapted, through movement of the loader, to correspond with a through seat provided in a punch holder and positioned below the loader, the through seat and relative cavity being coaxial with a corresponding blanking recess of the lower part of the die, the through seat enabling a punch to be transferred from a rest position, in which the punch is completely contained within the relative cavity, to an operating blanking position, the loader comprising a solid part which is adapted to be brought into a position corresponding with said through seat by moving the loader;

a first pneumatic means enabling a pressurized fluid to be fed to that the cavity located in a position corresponding with the through seat, to cause the punch to move from the rest position to the operative blanking position;

moving means for moving the loader to bring one of the cavities of the loader or the solid part of the loader into a position corresponding with said through seat;

a second pneumatic means to be activated when the first pneumatic means is inactive and when the loader lies in a position in which the relative loader cavity corresponds with the punch when the punch is in the operative position of the punch, said second pneumatic means enabling the punch to be returned from the operative position to the rest position; and means for closing the through seat.

2. The blanking die as claimed in claim 1, wherein the means for closing the through seat comprise a diaphragm movable between a first position in which the diaphragm closes the through seat and a second position in which the through seat remains open.

3. The blanking die as claimed in claim 2, wherein the diaphragm comprises a though hole through which a lower part of the punch can pass when the diaphragm is in the opening position.

4. The blanking die as claimed in claim 2, further comprising third pneumatic means to move the diaphragm from its opening position to its closing position, and fourth pneumatic means to move the diaphragm from its closing position to its opening position.

5. The blanking die as claimed in claim 1, wherein said loader is configured as a tray.

6. The blanking die as claimed in claim 1, wherein said loader is shaped as a drum.

* * * * *

UNITED STATES PATENT AND TRADEMARK OFFICE

CERTIFICATE OF CORRECTION

PATENT NO. : 8,739,668 B2
APPLICATION NO. : 13/474511
DATED : June 3, 2014
INVENTOR(S) : Massimo Negrello, Dario Muti and Mario Checchin It is certified that error appears in the above-identified patent and that said Letters Patent is hereby corrected as shown below:

Title Page:

Item (73) of the patent (Assignee), please delete "Corrado S.p.A." and replace with "Corrada S.p.A."

Signed and Sealed this
Ninth Day of September, 2014

Michelle K. Lee

Michelle K. Lee
*Deputy Director of the United States Patent and Trademark Office*